US005167599A

United States Patent [19]

Haller

[11] Patent Number: 5,167,599

[45] Date of Patent: Dec. 1, 1992

[54] JUMP ROPE APPARATUS

[76] Inventor: Anne L. Haller, 14 Idaville York Springs Rd., Idaville, Pa. 17337

[21] Appl. No.: 905,440

[22] Filed: Jun. 29, 1992

[51] Int. Cl.[5] ..... A63B 5/22

[52] U.S. Cl. ..... 482/81; 482/148

[58] Field of Search ..... 482/81, 82, 148, 16; 248/74.2, 165, 166, 168, 170

[56] References Cited

U.S. PATENT DOCUMENTS 3,595,571 7/1971 Spinnett ..... 482/81

4,739,985 4/1988 Rudell et al. ..... 482/81

*Primary Examiner*—Stephen R. Crow

*Attorney, Agent, or Firm*—Leon Gilden

[57] ABSTRACT

A support base is arranged to include a plurality of legs retractably mounted within a sleeve that is telescopingly received over leg-receiving slots. The organization includes a telescoping post structure mounting a support arm structure therefrom, with the support arm structure having a container member arranged to include a first and second container shell to receive a rope end therewithin. The organization is arranged to permit rotation of a rope in a jump rope procedure, wherein a modified aspect of the invention includes a plurality of support containers arranged for rotation synchronized relative to one another and displaced one hundred eighty degrees relative to one another.

3 Claims, 5 Drawing Sheets

JUMP ROPE APPARATUS

BACKGROUND OF THE INVENTION

1. Field of the Invention

The field of invention relates to jump rope apparatus, and more particularly pertains to a new and improved jump rope apparatus wherein the same permits rotative support of a jump rope manually rotated relative to the apparatus.

2. Description of the Prior Art

To permit ease of effecting a jump rope procedure when limited individuals are available, is availed in the instant invention providing for a compact organization readily stored during periods of non-use. Prior art jump rope structure includes a motorized jump rope member mounted on a support post structure as set forth in the U.S. Pat. No. 4,739,985 to Rudell.

U.S. Pat. No. 4,618,142 to Joseph sets forth a jump rope having a weighted bar mounted thereto for exercising.

U.S. Pat. No. 4,699,375 to Appelbaum, et al. sets forth a system for utilizing skip rope exercising having a tread mat and sensor imbedded therein responsive to impacting on the mat for read-out relative to adjacent instrumentation relative to a jumping procedure.

Accordingly, it may be appreciated there continues to be a need for a new and improved jump rope apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of jump rope apparatus now present in the prior art, the present invention provides a jump rope apparatus wherein the same is arranged for the rotative mounting of a distal end of a jump rope permitting ease of rotation of the jump rope in a jump roping game procedure. As such, the general purpose of the present invention, which will be described subsequently in greater detail, is to provide a new and improved jump rope apparatus which has all the advantages of the prior art jump rope apparatus and none of the disadvantages.

To attain this, the present invention provides a support base arranged to include a plurality of legs retractably mounted within a sleeve that is telescopingly received over leg-receiving slots. The organization includes a telescoping post structure mounting a support arm structure therefrom, with the support arm structure having a container member arranged to include a first and second container shell to receive a top end therewithin. The organization is arranged to permit rotation of a rope in a jump rope procedure, wherein a modified aspect of the invention includes a plurality of support containers arranged for rotation synchronized relative to one another and displaced one hundred eighty degrees relative to one another.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jump rope apparatus which has all the advantages of the prior art jump rope apparatus and none of the disadvantages.

It is another object of the present invention to provide a new and improved jump rope apparatus which may be easily and efficiently manufactured and marketed.

It is a further object of the present invention to provide a new and improved jump rope apparatus which is of a durable and reliable construction.

An even further object of the present invention is to provide a new and improved jump rope apparatus which is susceptible of a low cost of manufacture with regard to both materials and labor, and which accordingly is then susceptible of low prices of sale to the consuming public, thereby making such jump rope apparatus economically available to the buying public.

Still yet another object of the present invention is to provide a new and improved jump rope apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
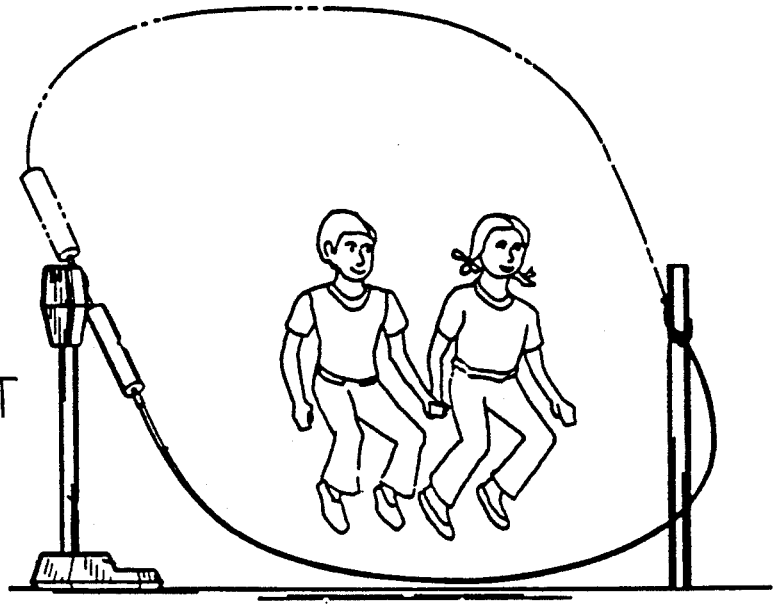
FIG 1 PRIOR ART
FIG. 1 is an isometric illustration of a prior art jump rope apparatus in use.

With reference now to the drawings, and in particular to FIGS. 1 to 6 thereof, a new and improved jump rope apparatus embodying the principles and concepts of the present invention and generally designated by the reference numeral 10 will be described.

Figure 2:
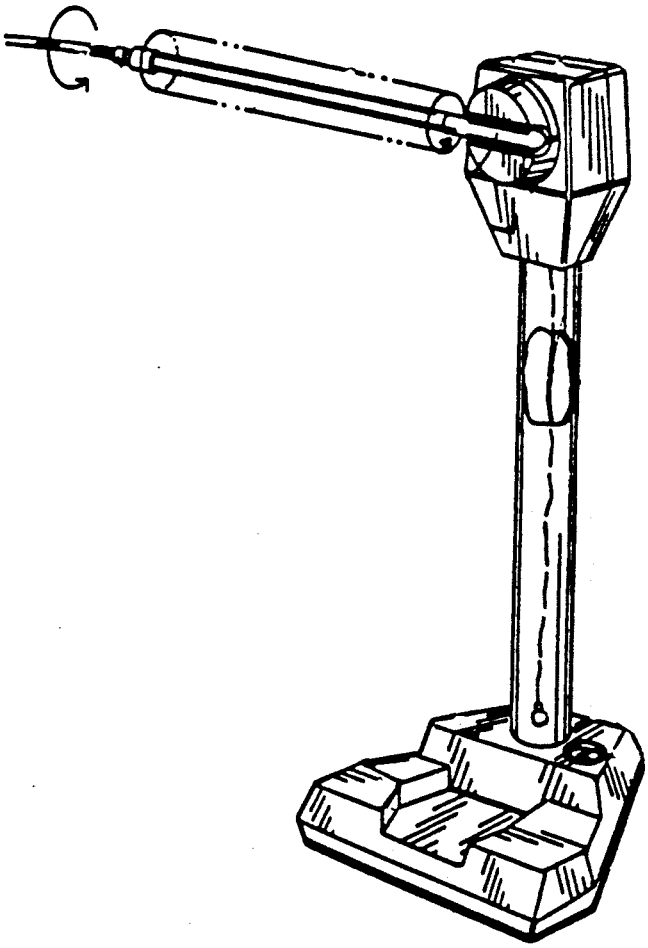
FIG 2 PRIOR ART
FIG. 2 is an enlarged isometric illustration of a prior art jump rope apparatus, as set forth in FIG. 1.

The FIGS. 1 and 2 illustrate the prior art jump rope apparatus as set forth in U.S. Pat. No. 4,739,985, wherein a support post mounts a motorized rotative member to effect rotation of a jump rope for use by individuals.

Figure 3:
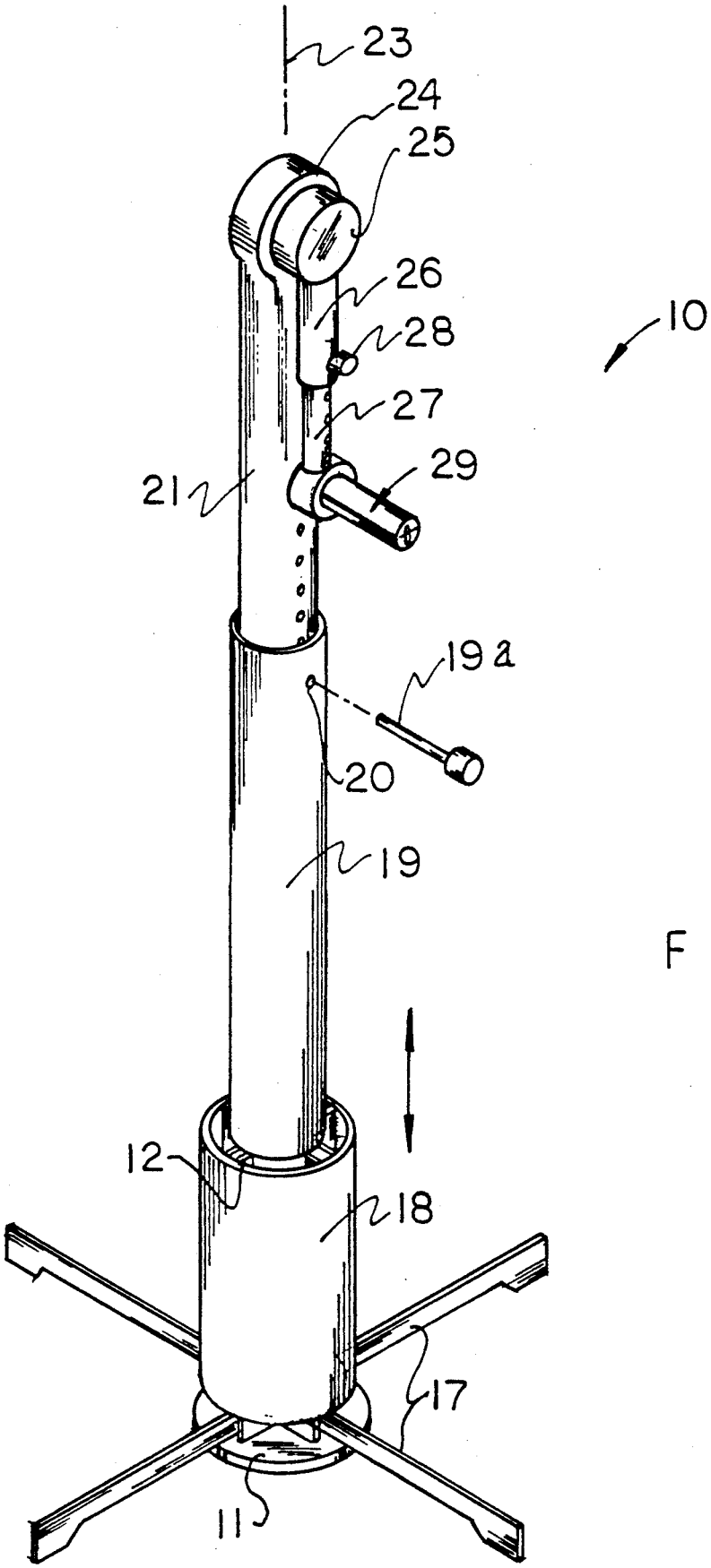
FIG. 3 is an isometric illustration of the instant invention.
Figure 4:
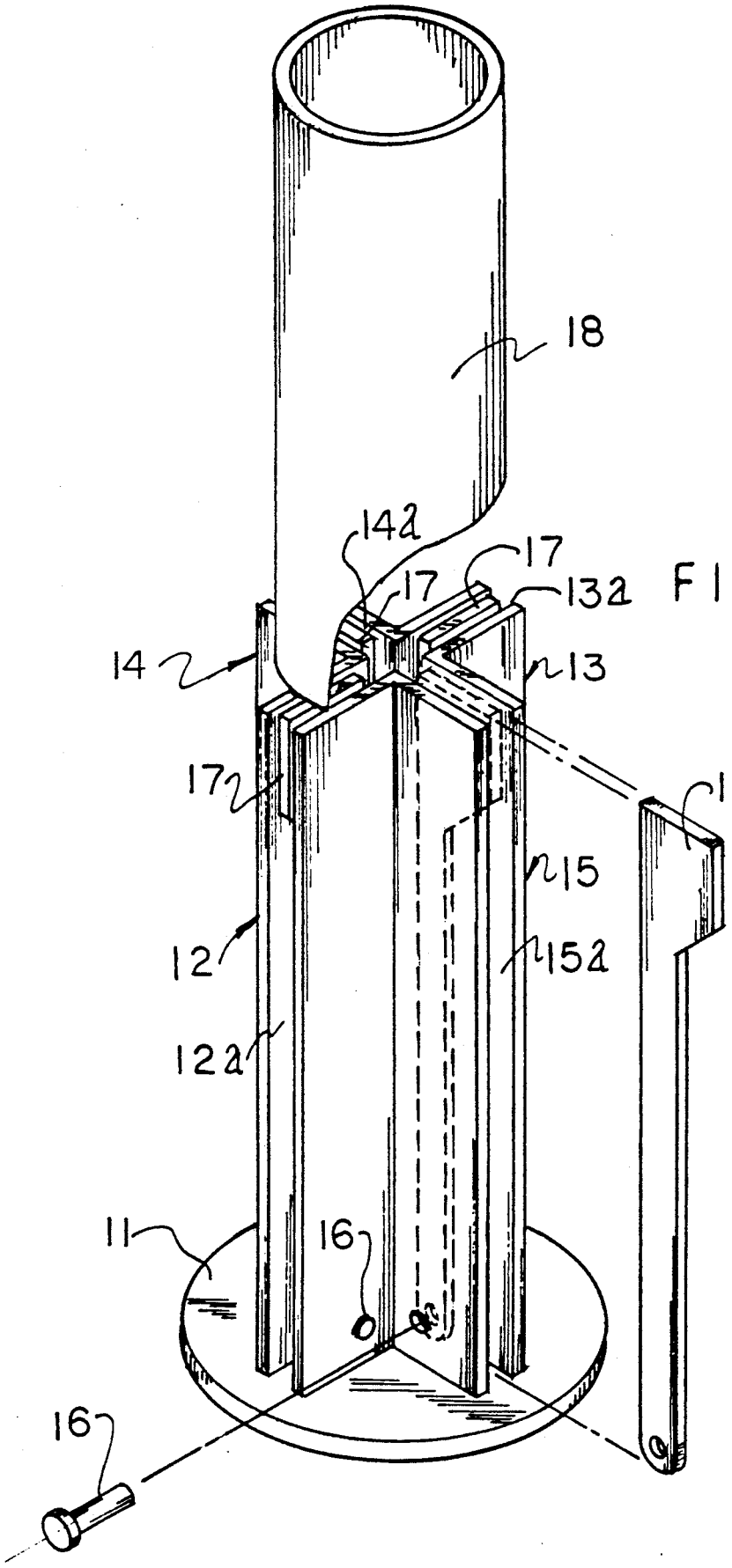
FIG. 4 is an isometric illustration, partially in section, of the base portion of the jump rope apparatus of the invention.
Figure 5:
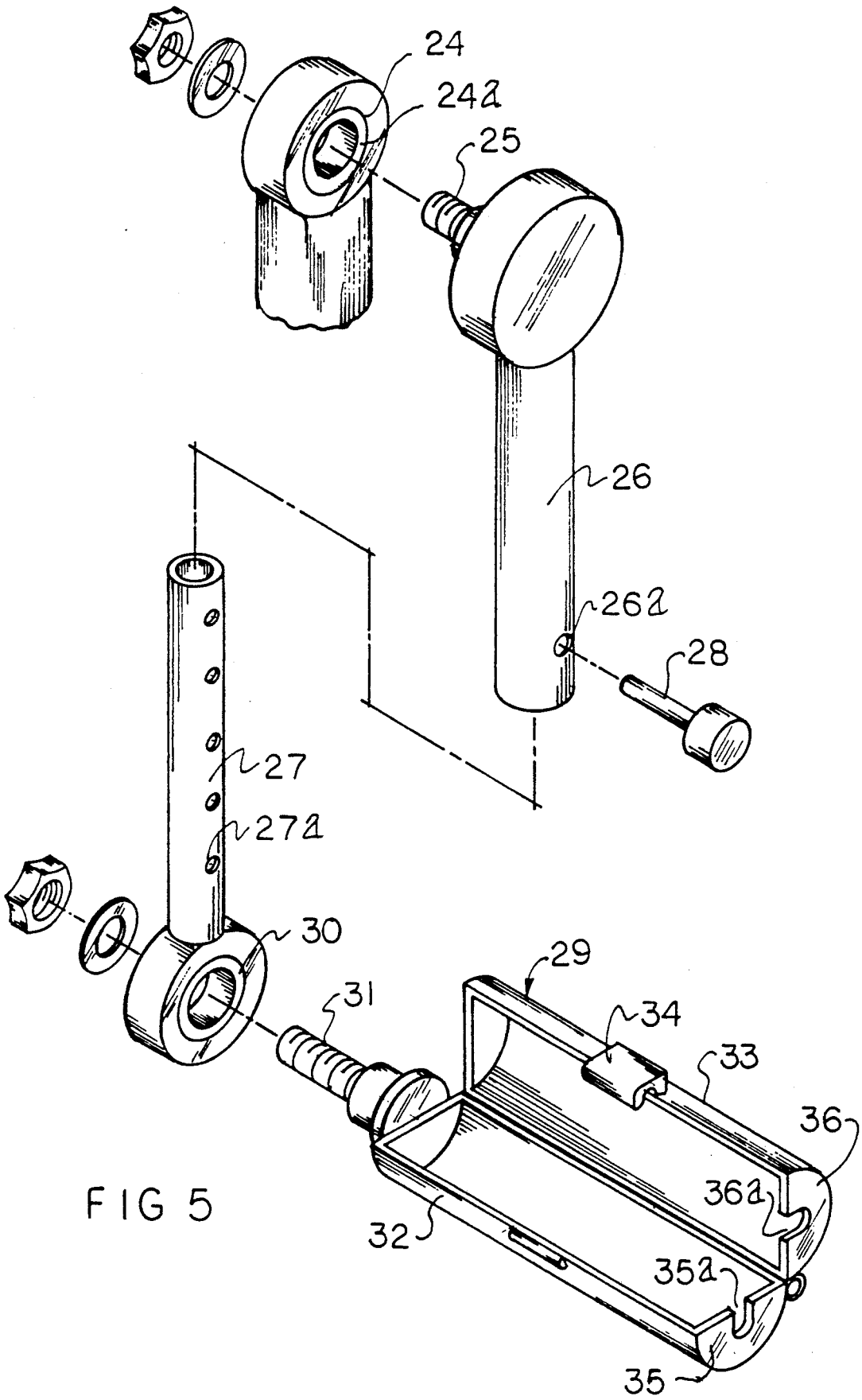
FIG. 5 is an isometric exploded view of the jump rope support and rotative structure of the invention.

More specifically, the jump rope apparatus 10 of the instant invention essentially comprises a base plate 11 having a plurality of flange pairs orthogonally mounted to the base plate defined by a respective first, second, third, and fourth flange pair 12, 13, 14, and 15 respectively. The first and second flange pairs 12 and 13 are longitudinally aligned, wherein a first slot 12*a* is arranged in a generally coplanar orientation relative to a second slot 13*a* to each receive a respective leg 17 pivotally therewithin pivotally mounted about a leg pivot axle 16 adjacent a lower end of each slot. Similarly, the third and fourth slots 13*a* and 14*a* are arranged in a coextensive coplanar relationship relative to one another to each receive a support leg 17 pivotally therewithin in a like manner about an associated pivot axle 16. The first and second slots 12*a* and 13*a*, as well as the first and second flange pairs 12 and 13 respectively, are orthogonally oriented relative to the third and fourth flange pairs 14 and 15 respectively and the respective slots 13*a* and 14*a*, wherein a predetermined width is defined by the first and second slots 12*a* and 13*a*, as well as the third and fourth slots 14*a* and 15*a*, that are substantially equal to an internal diameter of a tubular sleeve 18. When the tubular sleeve 18 is lifted, in a manner as illustrated in FIG. 4, the legs 17 are arranged and permitted to pivot downwardly, wherein when the sleeve is directed downwardly, frictional interengagement relative to outer peripheral edges of the flange pairs maintain the legs orthogonally relative to a central axis 23 of the organization. A support post sleeve 19 is coaxially aligned relative to the central axis 23 and is mounted to an upper distal end of the flange pairs at their intersection relative to one another to slidably receive in a telescoping manner a telescoping shaft 21, wherein a support sleeve bore 20 is cooperative with one of a row of telescoping shaft bores 22 directed into the telescoping shaft 21 receiving a lock pin 19*a* to effect telescoping displacement of the telescoping shaft 21 relative to the support sleeve 19. An upper distal end of the telescoping shaft 21 includes a support collar 24 having a support collar bearing 24*a* rotatably mounting an axle 25 orthogonally oriented relative to the central axis 23. The axle 25 includes an axle sleeve 26 depending orthogonally relative to the axle 25, with the axle sleeve 26 telescopingly receiving an extension shaft 27, wherein extension shaft apertures 27*a* to align with an axle sleeve aperture 26*a* and an associated extension shaft lock pin 28 to telescopingly position the extension shaft relative to the axle sleeve 26. An outer distal end of the extension shaft 27 mounts an extension shaft bearing 30 rotatably mounting a latch housing axle 31 that is orthogonally oriented relative to the extension shaft 27 as well as a central axis 23. The latch housing 29 includes a first and second container 32 and 33 hingedly mounted relative to one another about a cooperating hinge, including a latch member 34 to selectively secure the latch housing together in a closed configuration, in a manner as illustrated in FIG. 3 for example. The latch housing's first and second containers 32 and 33 respectively include respective first and second container forward walls 35 and 36 having respective first and second container forward wall slots 35*a* and 36*a* respectively, wherein when a rope knotted end is positioned within the container 29, the rope is thusly permitted to project through the first and second slots 35*a* and 36*a* that are in communication relative to one another through the respective first and second container forward walls 35 and 36.

In use, an individual positions one end of an associated jump rope knotted end within the container 29 and the other end is manually rotated in cooperation with the rotating assembly to include the axle sleeve 26, the extension shaft 27, etc.

Figure 6:
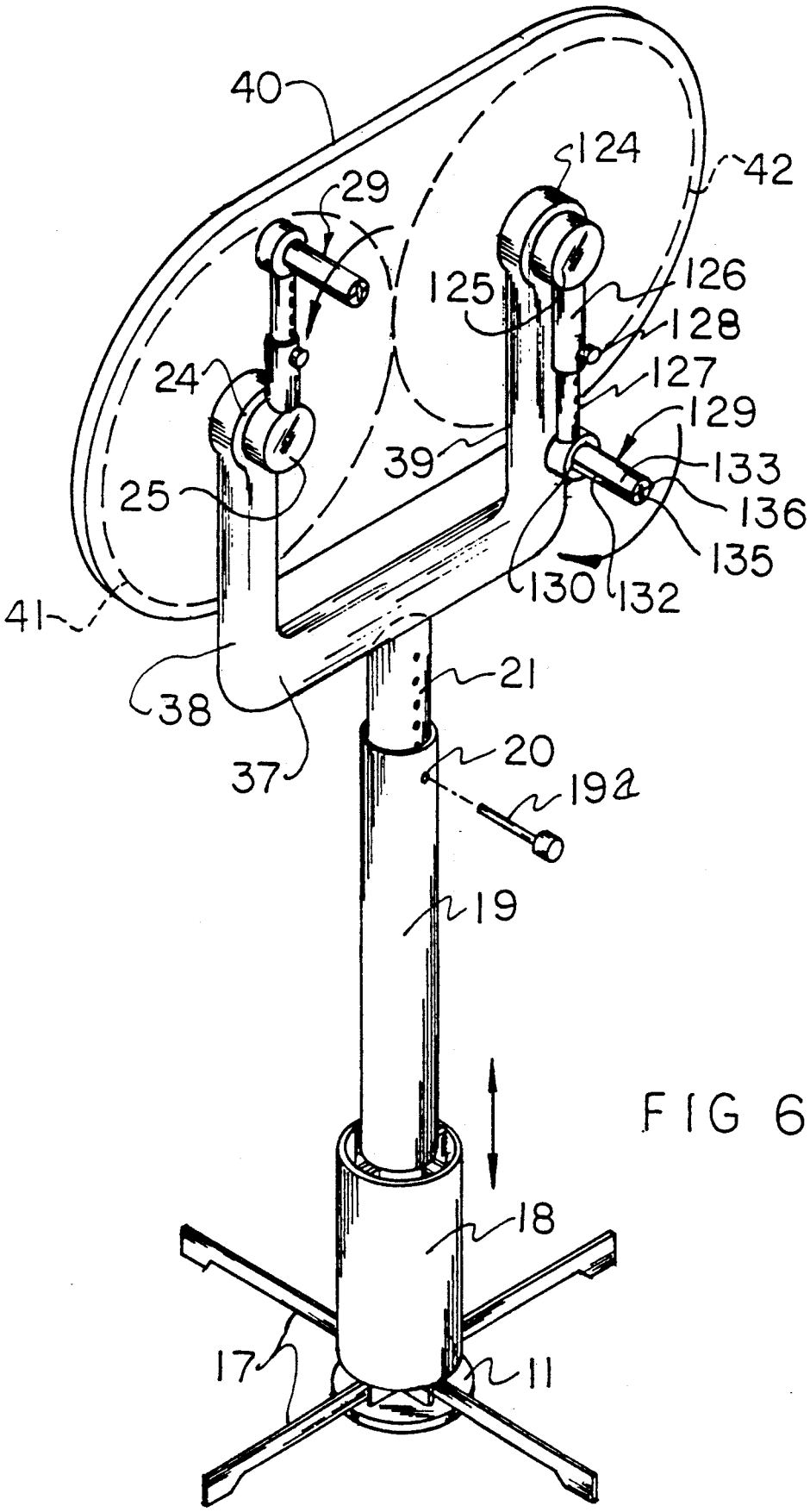
FIG. 6 is an isometric illustration of a modified aspect of the invention.

In the event that double ropes are utilized, the apparatus as illustrated in FIG. 6 is employed having a base leg 37 orthogonally mounted to an upper distal end of the telescoping shaft 21, wherein the base leg 37 orthogonally mounts first and second legs 38 and 39 respectively at opposed ends of the base leg 37. The first and second legs mount respective first and second axles 25 and 125 about respective first and second support collars 24 and 124. Respective first and second axle sleeves 26 and 126 telescopingly mount first and second extension shafts 27 and 127, in a manner described above, that in turn include first and second extension shaft bearings 30 and 130 at the outer distal ends of the extension shafts to rotatably mount first and second containers 29 and 129, in a manner as discussed above. The second container 129 includes respective second container first and second container shelves 132 and 133 having respective forward walls 135 and 136, including cooperating slots, in a manner as discussed above. A gear housing 40 is mounted rearwardly of the first and second legs having a first gear 41 fixedly mounted rearwardly of the first leg 38 coaxially and integrally joined to the axle 25, with the second axle 125 coaxially and orthogonally mounted to a second gear 42. The first and second gears 41 and 42 are in engagement relative to one another and are arranged to orient the first and second containers displaced one hundred eighty degrees relative to one another.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jump rope apparatus, comprising, a base plate, the base plate including a first flange pair and a second flange pair arranged in coextensive and coplanar relationship relative to one another defining respective first slot and second slot, with the first slot and second slot arranged in a coplanar relationship defining a predetermined width, and a third flange pair and a fourth flange pair orthogonally oriented relative to the first flange and second flange pair orthogonally mounted to the base plate arranged in a coplanar relationship defining a width equal to said predetermined width, and each slot includes a support leg received therewithin, and a tubular sleeve having an internal diameter equal to said predetermined width slidably received over the first, second, third, and fourth flange pair to effect slective securement and release of each leg within each slot, and a support sleeve fixedly mounted to an upper distal end of the first, second, third, and fourth flange pair medially oriented relative to the first, second and third flange pairs and orthogonally oriented relative to the base plate, with a telescoping shaft slidably mounted within the support sleeve, and first lock means arranged for selective locking of the telescoping shaft relative to the support sleeve, and the tubular sleeve, the support sleeve, and the base plate coaxially aligned along a central axis, with the first flange pair, second flange pair, third flange pair, and fourth flange pair symmetrically oriented radially about the central axis, and a first rotating head fixedly mounted relative to an upper distal end of the telescoping shaft, with the first rotating head including a latch housing, the latch housing including a first container and a second container pivotally mounted relative to one another about a hinge member, and the first container having a first container forward wall, the second container including a second container forward wall, with the first container forward wall and the second container forward wall oriented parallel relative to the central axis, with the first container forward wall having a first container forward wall slot, the second container forward wall having a second container forward wall slot, wherein the first container forward wall slot and the second container forward wall slot are in communicating relationship relative to one another to receive a rope therethrough.

2. An apparatus as set forth in claim 1 wherein the first rotating head includes an axle sleeve, the axle sleeve having a first end having an axle, the axle rotatably mounted within a support collar, the support collar fixedly mounted relative to the telescoping shaft, and the axle sleeve having an extension shaft telescopingly mounted and coaxially aligned relative to the axle sleeve, and the extension shaft having an extension shaft bearing mounted to an outer distal end of the extension shaft spaced from the support collar, with the extension shaft bearing receiving a latch housing axle, with the latch housing axle orthogonally oriented relative to the central axle, and the latch housing axle fixedly mounted to the first container.

3. An apparatus as set forth in claim 2 wherein the telescoping shaft includes a base leg, the base leg includes a first leg and a second leg, with the first leg and second leg orthogonally and fixedly mounted to the base leg in a parallel coextensive relationship relative to one another, with the first leg mounting the first rotating head thereto and the support collar mounted to an upper distal end of the first leg, and a second support collar mounted to an upper distal end of the second leg, and a second support axle rotatably mounted through the second support collar, and the second axle having a second axle sleeve orthogonally mounted to the second axle, the second axle sleeve having a second sleeve extension shaft telescopingly mounted to the second sleeve, and the second sleeve extension shaft including a second latch housing orthogonally mounted to the second sleeve, with the second latch housing displaced one hundred eighty degrees relative to said first latch housing, and the support collar axle including a first gear, and the second axle including a second gear, wherein the first gear and the second gear are arranged in engagement relative to one another to maintain the first latch housing and the second latch housing displaced relative to one another one hundred eighty degrees.

* * * * *